US011015372B2

(12) United States Patent
Izod et al.

(10) Patent No.: US 11,015,372 B2
(45) Date of Patent: May 25, 2021

(54) ANTI-BARRICADE DOOR STOP

(71) Applicant: SAFEHINGE LIMITED, Glasgow (GB)

(72) Inventors: Martin Izod, Glasgow Lanarkshire (GB); Jeremy Young, Glasgow Lanarkshire (GB)

(73) Assignee: SAFEHINGE LIMITED, Glasgow (GB)

( * ) Notice: Subject to any disclaimer, the term of this patent is extended or adjusted under 35 U.S.C. 154(b) by 588 days.

(21) Appl. No.: 15/573,312

(22) PCT Filed: May 12, 2016

(86) PCT No.: PCT/GB2016/051373
§ 371 (c)(1),
(2) Date: Nov. 10, 2017

(87) PCT Pub. No.: WO2016/181157
PCT Pub. Date: Nov. 17, 2016

(65) Prior Publication Data

US 2018/0128019 A1 May 10, 2018

(30) Foreign Application Priority Data

May 13, 2015 (GB) ..... 1508152

(51) Int. Cl.
*E05B 65/06* (2006.01)
*E06B 3/36* (2006.01)
(Continued)

(52) U.S. Cl.
CPC ..... *E05B 65/06* (2013.01); *E06B 1/045* (2013.01); *E06B 3/36* (2013.01); *E06B 5/10* (2013.01);
(Continued)

(58) Field of Classification Search
CPC ..... E06B 1/045; Y10T 292/1043; Y10T 292/1075; Y10S 292/15
(Continued)

(56) References Cited

U.S. PATENT DOCUMENTS 211,660 A * 1/1879 Hotchkiss ..... 16/64
1,302,168 A * 4/1919 Hughes ..... E05B 83/243 292/129
(Continued)

FOREIGN PATENT DOCUMENTS

EP 1837475 A1 9/2007
FR 2050713 2/1971
(Continued)

OTHER PUBLICATIONS

European Patent Office; Office Action Communication pursuant to Article 94(3) EPC; Nov. 21, 2018, Application No. 16724099.3-1005.

*Primary Examiner* — Carlos Lugo
(74) *Attorney, Agent, or Firm* — Dickinson Wright PLLC

(57) ABSTRACT

The present invention relates to a door jamb assembly comprising a door stop member movably mounted thereon, configured such that the door stop is selectively operable to move from an extended, door-engaging position into a retracted door-disengaging position, and where the door stop member is adapted to initially move directly away from the face of a door with which it is in contact during use. Associated methods, door assemblies and suchlike are also provided. The door jamb assembly of the present invention is of particular use in situations where a door may be barricaded.

37 Claims, 8 Drawing Sheets

(51) Int. Cl.
*E06B 1/04* (2006.01)
*E06B 5/10* (2006.01)
*E05B 65/00* (2006.01)
*E06B 1/52* (2006.01)

(52) U.S. Cl.
CPC ..... *E06B 1/526* (2013.01); *Y10S 292/15* (2013.01); *Y10T 292/1043* (2015.04)

(58) Field of Classification Search
USPC ..... 49/400–402, 504, 505
See application file for complete search history.

(56) References Cited

U.S. PATENT DOCUMENTS 1,864,577 A * 6/1932 Baum Isaac A ..... E05F 5/06 49/504
3,172,168 A * 3/1965 Suska ..... E05F 5/04 49/400
3,862,774 A 1/1975 Johnson
3,888,526 A * 6/1975 Dennis ..... E05C 7/00 292/97
3,894,761 A * 7/1975 Brennan, Jr. ..... E05D 13/04 292/225
4,045,065 A * 8/1977 Johnson ..... E05B 63/24 292/341.17
4,110,867 A * 9/1978 Gwozdz ..... E05B 65/06 16/82
4,765,662 A * 8/1988 Suska ..... E05B 63/248 292/219
5,036,685 A 8/1991 Napolitano
5,429,399 A * 7/1995 Geringer ..... E05B 41/00 292/251.5
5,746,455 A * 5/1998 Takimoto ..... E05C 1/04 292/145
5,897,149 A * 4/1999 Frolov ..... E05C 19/166 292/144
6,244,636 B1 * 6/2001 Rissone ..... E05B 63/0069 16/82
7,350,836 B2 * 4/2008 Simpson ..... E05C 17/48 16/82
8,128,134 B2 * 3/2012 Kelly ..... E05F 5/02 16/82
9,598,894 B2 * 3/2017 Raz ..... E05B 17/0025
9,915,083 B2 * 3/2018 Ford ..... E05F 15/70
2008/0264119 A1 * 10/2008 Thomas ..... E05B 63/0052 70/77

FOREIGN PATENT DOCUMENTS

FR 2622627 5/1989
FR 2972477 9/2012
GB 2283275 A 3/1995
GB 2415739 A 1/2006
WO WO2014057269 A1 4/2014

* cited by examiner

ANTI-BARRICADE DOOR STOP

CROSS-REFERENCE TO RELATED APPLICATIONS

The present application is a 35 U.S.C. Section 371 national stage filing of International Patent Application No. PCT/GB2016/051373, filed 12 May 2016, and through which priority is claimed to United Kingdom Patent Application GB 1508152.4, filed 13 May 2015, the disclosures of which are incorporated herein by reference in their entireties.

The present invention relates to door systems which are adapted to assist in resolving a door barricade situation, e.g. when an obstruction has been put in place to prevent a door from opening. The invention relates to a door stop which in normal use prevents a door from swinging in both directions (i.e. creates a single swing door), but which when required, (e.g. when a barricade prevents the door opening in a first direction) is adapted to permit opening of the door in a second direction when required. The invention also relates to associated systems, methods and apparatuses.

BACKGROUND OF THE INVENTION

Doors barricades occur in various situations, but are particularly prevalent and of significant concern in mental health environments. In many cases a patient may obstruct a door (e.g. a bedroom door) to prevent it from swinging open. This may be done for various reasons, but in some cases the patient may wish to harm themselves or possibly commit suicide. In other cases it may be for nuisance value, or because the patient has become confused, frightened or otherwise disturbed. Whatever the reason for the barricade, it is clearly desirable that it is resolved as quickly as possible, and with the minimum of disturbance and damage.

Barricades are typically only possible with a single-swing door, because a double-swing door can readily be opened in the other direction to allow the obstruction to be cleared. However, double-swing doors are often undesirable (e.g. in bedrooms), not least because they do not permit privacy and have an 'institutional' feel to them.

It is known in the art to provide a door stop which is removable or which can be moved to convert a door from a single-swing mode to a double-swing mode. Examples known in the art include the MOVAstop (available from Safehinge/Primera), the SwingStop® (from Kingsway Group), and the Logica emergency release door stop (from Kingsway Group).

- MOVAstop is a door stop which can be completely removed, e.g. in a barricade situations, to allow the door to swing open. It is removed by actuating a lever which releases catches holding the stop in position. The door stop is then detached and the door can swing open.
- The SwingStop® is a hinged door stop, adapted to pivot out of the way to permit a door to swing open. In a situation of barricade an 8 mm key is used at two points and turned to release the stop, which is then pivoted outwards on hinges which are located distal of the door and door stops using two recessed finger grips. Once this has been done the door is then free to be swung outwards.
- The Logica emergency release door stop is typical of a number of similar anti-barricade door stops. It is a point stop, i.e. it acts a single point on the door (in the manner of a conventional door bolt), rather than an elongated stop which extends along a substantial proportion of the door's height. The stop is adapted to slide into the frame, thus allowing the door to open; the stop slides in much the same way as a standard door mortise lock, but retracting into the frame rather than the door and acting on the face of the door.

Existing solutions have a number of drawbacks, which have been identified by the applicants, including:

- Stops which retract into the frame in a sliding manner, can be difficult or impossible to operate in a barricade situation. Typically when a door is barricaded, there is considerable force acting on the stop, and this results significant friction, which hinders to prevents sliding of the stop and release of the door.
- Known stops which are mounted to pivot out of the way of the door open in an arc which is initially outwards from the door jamb, usually substantially parallel to the door, before swinging away from the door. Again, this is prone to jamming as a result of friction when a load is applied, because the outward movement of the stop, away from the doorjamb, can be affected by friction. In some cases the geometry of such stops actually requires that the door move slightly to allow the stop to pivot, and this may be impossible when a significant force is applied to the door.
- Accordingly, in both the above cases, it can be appreciated that stops which move laterally, e.g. parallel to the door to be released can present problems with jamming.
- Stops which require multiple points to be actuated to release the door (e.g. the SwingStop®, which requires operation of two 8 mm keys) are time consuming and cumbersome to release. In an emergency situation this can be particularly problematic.
- Many stops known in the art are not intuitive to use, and thus training is required, and even with training some staff may have problems with operation of the stop and this results in delays.
- Stops which act a single point result in point loading and associated high pressures and impacts on both the door and stop, e.g. when the door swings closed in normal use, or when force is applied in a barricade situation. This results in wear and tear on the door (and the stop) as force is not dissipated across a comparatively large area.
- Many prior art stops require a user to operate them when positioned in front of the door or by placing hands on or near the door stop; this results in a risk that upon release of the stop the door can swing open hitting the user or trapping a finger or hand, or the like.
- Stops which are detachable from the frame present a risk that they could be used as a weapon in certain challenging environments, or may be damaged once removed, or, at least they require a further action to safely stow or store the detachable stop.
- Stops which do not cover the gap between the door and the frame result in poor privacy and an institutional feel, which is undesirable.

Accordingly, it will be seen that there is a need for improved releasable door stops which overcome some or all of the above shortcomings.

Statements of the Invention

According to a first aspect of the present invention, there is provided a door jamb assembly comprising a door stop member movably mounted thereon, configured such that the door stop is selectively operable to move from an extended, door-engaging position into a retracted door-disengaging position, characterised in that the door stop member is adapted to initially move directly away from the face of a door with which it is in contact during use.

In preferred embodiments the door stop member is pivotably mounted on the doorjamb, and thus is selectively operable to pivot from the extended to the retracted position, and is adapted to initially pivot directly away from the door. However, in some embodiments the door stop member could be non-pivotably mounted on the food jamb; for example, it could be mounted to allow linear movement, e.g. slideably mounted.

The door jamb assembly can be for vertical or horizontal positioning in a door frame.

This contrasts with known pivoting anti-barricade door stop systems in which the door stop initially move away from the jamb and across the face of the door, typically substantially parallel to the face of door, in the initial stages of movement. Prior art door stops, such as the SwingStop®, have the hinge located distal to the face of the door (i.e. further from the door than the door stop), and thus the arc defined by the pivoting movement of the door engaging face of the door stop (referred to hereinafter as the 'leading face') is away from the door jamb, and laterally across the face of the door. At best this requires a user to move the stop manually (which raises the risk of trapping or other injury), at worst it can result in binding of the door stop as a result of friction between the stop and the face of the door.

It is a significant advantage of the invention that the door stop member is adapted such that initial movement of the door stop member is directly away from the face of the door (i.e. in the direction of the door will initially swing when the stop is released). This means that friction (e.g. static friction) between the door and the door stop member is unlikely to result in partial or complete jamming of the door stop member. Furthermore, it means that any force applied to the door by the barricade acts to push the door stop member into the retracted position, and this avoids the need for a user to manually (or otherwise actively) move the door stop. While in some cases the user may need to pull the door open by a handle or the like (e.g. if a barricade is blocking opening of the door but not pushing upon the door), the user should not have to touch the stop at any point.

Accordingly, the door stop member is adapted to at least initially move in a direction which avoids significant lateral movement across the face of the door. Excessive lateral movement results in an increased risk of the door stop binding against the face of the door, and also makes it necessary for a user to actively move the door stop (as opposed to the situation in the present invention where movement of the door typically acts to move the door stop without any need for active movement thereof). It will be understood that for a pivotably mounted door stop member the direction of movement will change as the door stop member pivots, and, as such, it is the initial movement which is most critical. As the member pivots and approaches, say 90 degrees, the movement will be substantially lateral to the face of the door, but at that point static friction will have ceased to exert an effect and the area of contact between the leading face of the door stop member and the face of the door will be minimal (the leading face of the door stop member will be at a slope relative to the face of the door)—thus further pivoting movement of the door stop member will not be affected by binding.

Suitably the door stop member is configured such that the initial movement is in a direction of from 50 to 130 degrees relative to the face of the door (i.e. 40 degrees either side of perpendicular to the face of the door), more preferably from 70 to 110 degrees, yet more preferably from 80 to 100 degrees relative to the face of the door. For completeness, in a geometric sense it will be understood that, where the door stop member is pivotably mounted on the door jamb, these angles refer to the angle made relative to the plane defined by the face of a door by a tangent to the curve through which the door stop pivots when moving from the extended to the retracted position, and where the point of tangency corresponds to the point on the curve at which the door stop is located when in the extended position.

In a preferred embodiment the stop initially moves in a direction which is substantially perpendicular to, and away from, the face of the door.

It will be appreciated that, where the door stop member is pivotably mounted on the door jamb, the initial movement of the door stop member relative to the door will depend on the position of the pivot point of the door stop member. Suitably the pivot point is located substantially in line with the leading face of the door stop member; this will result in an initial movement which is substantially perpendicular to the face of the door. The advantage of this is that the pivoting movement of the door stop member is away from the face of the door (i.e. in the direction of the door will initially swing when the stop is released), without any substantial movement away from the jamb (i.e. across the face of the door) being required. Alternatively, the pivot point can be located beyond the leading face of the door stop member (i.e. in the direction towards the door)—this will result in an initial angle movement which is somewhat towards the jamb. Alternatively, the pivot point can be located away from the leading face of the door stop member (i.e. somewhat away from the door)—this will result in an initial movement which is somewhat away from the jamb. However, it will be noted in the latter two cases that the initial movement of the door stop should not result in significant lateral movement which results in problems with friction or the need to actively move the door stop. It is generally preferable that the pivot point is positioned substantially flush with, or recessed into, the jamb.

It should be noted that, in general, references to the face of the door and the like are made with reference to the door in the closed position, i.e. when it abuts against the door stop member in normal use, unless the context dictates otherwise. This can also be referred to as the 'zero position' or 'neutral position'. It should also be noted that the invention discusses the position of the door by way of convenience and clarity, but this does not mean that a door need actually be present in the invention; in several aspects of the invention the door jamb assembly need only be adapted for use in a door frame. A direction which is 'away from the door' or suchlike means the direction in which movement of the door from the closed position is normally limited by the door stop member (i.e. typically away from the room which the door opens). A direction which is 'towards the door' or suchlike means the direction from the closed position in which the door is free to move in normal use (i.e. typically into the room which the door opens).

Preferably the door jamb has a recess adapted to receive the door stop member. Suitably the recess is a channel provided in the door jamb. Preferably the recess is elongate and is disposed longitudinally in the doorjamb. Preferably the recess runs substantially along the entire length of the door jamb (it may be desirable in some cases for the recess to stop short of the top and/or bottom of the jamb). However, in some cases a recess may not be required, e.g. if the door stop member is substantially planar and can thus simply lie flat against the door jamb, or where a sloping or narrow jamb is used.

Preferably the door stop member is elongate and is mounted longitudinally on the doorjamb. Preferably the door stop member runs substantially along the entire length of the door jamb (e.g. it may be desirable in some cases the door stop member to stop slightly short of the top and/or bottom of the jamb).

Typically the door stop member and the recess are parallel to each other.

It will be apparent that the recess is suitably at least the same length as the door stop member, such that the recess can receive at least a portion of the door stop member when in the retracted position.

The recess (e.g. channel) is preferably of suitable depth and dimensions such that it can receive substantially the entire door stop member when the door stop member is in the retracted position. In practice, the projection of the door stop member in the retracted position should be small enough to allow a door to swing past the stop member. This does not necessarily require that the door stop member is entirely contained within the recess. In other words, the recess can suitably be dimensioned such that the door stop member can fit within it, leaving at most a small proportion of the door stop member projecting from the recess, e.g. less than 20% by volume, more preferably less than 10% by volume of the door stop member projects from the recess, and/or such that 5 mm or less, more preferably 2 mm or less of the door stop member projects from the recess.

Preferably the door stop member is mounted on the door jamb by a hinge means.

The hinge means can comprise any suitable type of hinge, and there are a wide range of hinges known in the art. The hinge should be sufficiently robust to resist the forces applied to the door stop in normal use, and its size and configuration should be suited to the relevant dimensions and geometry of the door jamb assembly. The hinge preferably does not contact the face of the door, and this can be achieved by recessing the hinge into the jamb, or recessing it into a face of the door stop member.

A preferred hinge means is a continuous hinge (also known as a piano hinge) which runs substantially the entire length of the door stop member. However, the hinge means could be discontinuous, and, for example, could comprise several individual hinges (e.g. butt hinges) along the length of the door stop member. However, it will be appreciated that many types of hinges could readily be used.

The door stop member can have any suitable shape, but preferably it is able to rotate into the recess into a retracted position in which a door can swing open. Typically the door stop member has a generally constant cross-sectional profile along its length.

In a preferred embodiment the door stop member has a cross-section which comprises a sector of a circle. This allows for the width of a channel to be minimised relative to the dimensions of the door stop member. It also provides the advantage that any gap between the surface of door stop member and the edge of the channel can be kept constant as the door stop member pivots into the channel. Where the door stop member comprises a cross-section which is a sector of a circle, it is preferred that the pivot point of the hinge means is located substantially at the centre of the circle which is partly defined by the sector.

Where the door stop member comprises a cross-section which is a sector of a circle, the sector suitably has a central angle of from 70 to 180 degrees, preferably from 80 to 140 degrees, and more suitably from 90 to 120 degrees. In one particularly preferred embodiment the door stop member has a quadrant cross-section (i.e. the sector defined by a central angle of 90 degrees).

Preferably the door jamb assembly comprises at least one stop means which is adapted to limit movement of the door stop member relative to the doorjamb. Suitable stop means can include a projection on one, other or both of the door stop member and the door jamb which abuts against a corresponding surface to prevent further movement of movement of the door stop member relative to the door jamb.

Suitably the door stop member comprises at least one projection which is adapted to limit movement of the door stop member and/or to cover a gap between the door stop member and the edge of the recess, e.g. a gap between the arcuate face of the door stop member and the edge of the channel.

In a preferred embodiment the at least one projection comprises a lip which is an extension of the leading face of the door stop member, the lip extending beyond an arcuate surface of the door stop member. Such a lip can act as a stop by contacting the edge of the channel and thereby limiting movement of the door stop member into the channel. The lip preferably extends for substantially the entire length of the door stop member. Advantageously the lip also serves to cover and occlude any gap between the door stop member and the edge of the channel when the door stop member is in the retracted position, which has advantages both in terms of aesthetics and safety.

The door stop member may comprise a second projection which is adapted to limit movement of the door stop member in the direction of the extended position. Suitably the second projection is adapted to prevent further movement when the leading face of the door stop is substantially parallel with the face of a door in the closed position. The second projection is suitably a lip which extends beyond an arcuate surface of the door stop member. The lip preferably extends for substantially the entire length of the door stop member. Advantageously the lip also serves to cover and occlude any gap between the door stop member and the edge of the channel when the door stop member is in the extended position, which has advantages both in terms of aesthetics and safety.

In one embodiment of the invention the door stop member comprises two elongate rectangular planar surfaces, which are angled at between 80 and 120 degrees (preferably substantially perpendicular) to one another, the planar surfaces substantially meeting along one long edge of each planar surfaces to form a vertex when viewed in cross-section, the acute or obtuse angle defined by the two planar surfaces comprising a curved surface, e.g. an arc, between the two planar surfaces. Thus, in a preferred embodiment the two planar members and the arcuate surface define a sector, and suitably a quadrant. Preferable the two planar surfaces extend beyond the arcuate surface and thereby define elongate projections (lips) which can act to limit movement and/or cover a gap between the arcuate surface and the edge of the channel. The hinge means is preferably provided at or near the apex of the planar members, and more preferably the pivoting movement of the member is substantially concentric with the arcuate surface.

The door jamb assembly of the present invention preferably comprises a locking means to selectably hold the door stop member in the extended position (e.g. during normal use) and release it to permit it to move into the retracted position (e.g. in a barricade situation). There are a wide range of locking means which could potentially be used in the present invention. These include mechanical latches (which can either be mechanically or electrically operated) or electrical locks, such a electromagnetic locking mechanisms, or a combination of both.

In a preferred embodiment the locking means comprises a multi-point locking means, i.e. a locking means which holds the door stop member in position at two or more (preferably more than two, e.g. 3, 4, 5, 6 or more) points along the length of the door stop member. A single-point locking means can be used, but in general is less preferred as it typically results in a less robust locking of an elongate stop.

Preferably the multi-point locking means comprises an elongate actuation member (e.g. a rod, rail, wire or the like) which is adapted to move a plurality of latch members between a locked position and an unlocked position. The latch members associated with the actuation member (e.g. mounted on, or defined by, the actuation member) suitably cooperate with corresponding latch members associated with the door stop member (e.g. e.g. mounted on, or defined by, the door stop member), whereby in the locked position the latch members associated with the door stop member abut against the latch members associated with the elongate actuation member and thereby prevent movement of the door stop member, and whereby in the unlocked position latch members associated with the door stop member do not abut against the latch members associated with the elongate actuation member and movement of the door stop member into the retracted position is permitted.

Suitably the corresponding latch members associated with the elongate actuation member and the door stop member comprise corresponding projections (e.g. in a preferred embodiment corresponding rollers and wedges) which engage to lock the door stop member in the extended position and disengage to allow the door stop member to retract. For example, rollers can be mounted on the elongate actuation member which are operable to move between first and second positions in which, respectively, they engage with and disengage with wedges provided on the door stop means.

It is preferred that, where rollers are used in the locking means, the rollers are braced against deflection as a result of force applied to the rollers by the door stop member. Suitably a secondary roller can be provided in association with the (primary) roller, the secondary roller configured to abut against a surface of the door jamb assembly such that force applied to the primary roller is transmitted to the secondary roller and via the secondary roller to the surface. The secondary roller can be a separate roller or can be integral with the primary roller. The secondary roller is typically coaxial with the primary roller, and is suitably mounted on the same axle. Other suitable bracing means could be used.

It is highly preferred that the multi-point locking means is adapted be operated from a single point, e.g. via a single key or other tool, or using a fob or key card or the like. Operation from a single point allows for rapid and convenient retraction of the door stop member when required. This can be readily achieved by using a single elongate actuation member which has a number of latching members provided thereupon, as movement of the actuation member results in locking/unlocking at multiple points. However, other mechanisms could also be used, e.g. multiple individual latches which are operated electronically via a single controller.

Suitably the multi-point locking means comprises a control means to control movement of the actuation member. The control means suitably comprises a retaining mechanism, which is adapted to releasably retain the actuation member in a locked position. The retaining mechanism can be any suitable mechanism which is able to releasably retain the actuation member in the locked position. For example, the retaining mechanism can be a latch (which can be mechanically or electrically controlled), or it could be an electromagnet or the like.

The retaining means is preferably adapted such that when the control means is activated by a user, the retaining means is released for passive movement of the actuation member from a locked position to an unlocked position. Alternatively, when the control means is activated by a user the actuation member can be actively moved from a locked position to an unlocked position.

In a preferred embodiment of the present invention the retaining mechanism is a latch which is adapted to retain a projection of the actuation member, e.g. a bolt attached to an arm.

In a preferred embodiment the actuation member is released so that is free to move from a locked position to an unlocked position. For example, when a latch is released, the actuation member can be free to move under gravity, under the action of a resilient means (e.g. a spring), or driven (e.g. by force acting on the door stop member, a mechanical driving means or an electrical means, such as a servo or solenoid) to the unlocked position. The controller can be activated by a manual mechanical means (e.g. a key or other tool), or by an electrical system (e.g. a fob, keypad, keycard, or the like).

In a preferred embodiment of the present invention the locking means is biased into an unlocked configuration, e.g. by a resilient biasing means. For example, in the embodiments described above, the actuation member can be connected to a biasing means (e.g. a comprising resilient member such as a spring) which urges the actuation member into an unlocked position.

In a preferred embodiment, the door jamb assembly comprises a failsafe mechanism to allow the door stop member to be retracted or removed in the event of a failure in the primary system. Preferably the failsafe system is mechanical (e.g. it uses a key or similar manual tool). The failsafe mechanism can be any mechanism which enables a user to mechanically disengage the door stop from the locking means, thus freeing the doorstop to move.

In one embodiment the failsafe mechanism allows the door stop member to be removed from the door jamb assembly in the event of failure to retract. Suitably the failsafe system comprises a plurality of corresponding connectors on the door stop member and a door stop member carrier. Retaining means are provided which hold the corresponding connectors on the door stop member and the carrier in an interlocked relationship. Suitably the retaining means is removable or otherwise capable of being disengaged. When the retaining means is disengaged the corresponding connectors are able to move into a non-interlocked relationship whereby the door stop member can be removed from the carrier.

Suitably the corresponding connectors on the door stop member and door stop member carrier comprise corresponding wedge elements that are adapted to engage via corresponding sloped surfaces and securely hold the door stop member on the carrier. Disengagement of the retaining means allows the door stop member to move relative to the carrier and thereby allow the corresponding wedge elements to disengage.

Suitably the retaining means comprises a removable retaining member that holds the door stop member in a fixed position relative to the carrier, e.g. a screw, pin or the like, or a catch.

Preferably the door jamb assembly comprises a reset mechanism which can be used to lock the door stop member in position after it had been released. Suitably the reset mechanism is adapted to engage the locking means, e.g. by moving an actuation member into a locked position.

Suitably retraction of the door stop member is achieved via an electrical system. Accordingly, the door jamb assembly can be connected to a source of electrical power, which can be a local power source such as a battery, and/or a remote source of power such as a national grid or local generator.

In a second aspect of the present invention there is provided a door frame comprising a door jamb as set out above.

Preferably the door jamb assembly is provided on the latch doorjamb, but it could be additionally or alternatively be provided on the top jamb.

In a third aspect of the present invention there is provided a door assembly comprising a door mounted in frame as set out in the second aspect of the invention.

The door is typically mounted such that when the door stop member is in the extended position the door cannot swing past the door stop member (and the door therefore operates as a single-swing door) and when the door stop member is in the retracted position the door can swing past the door stop member (and the door therefore operates as a double-swing door).

In a fourth aspect of the present invention there is provided a method of installing a door frame or a door assembly, the method comprising fitting a door jamb assembly according to the present invention to the edge of a door aperture in a wall.

In a fifth aspect of the present invention there is provided a method of operating a door assembly according to the third aspect of the invention, the method comprising operating the door stop member to move from an extended, door-engaging position into a retracted position in which it is substantially within the channel.

Preferably operating the door stop member comprises operating a locking means to release the door stop means, thereby allowing it to move into the retracted position, preferably as a result of force being applied to the door stop member by the door.

The method may comprise resetting the locking means to lock the door stop member in the extended position.

In a sixth aspect of the present invention there is provided a kit of parts comprising a door jamb assembly of the present invention (or parts sufficient to construct such an assembly). The kit may comprise a door and/or other door frame components.

The skilled person will appreciate that the various features and embodiments of any one of the abovementioned aspects of the invention can and should, of course, be applied to all other aspects of the invention.

Embodiments of the present invention will now be described, by way of non-limiting example, with reference to the accompanying drawings.

BRIEF DESCRIPTION OF THE FIGURES

FIG. 12B shows longitudinal movement the door stop member to disengage the carrier, and FIG. 12C shows the door stop member being removed from the carrier.

SPECIFIC DESCRIPTION OF EMBODIMENTS OF THE INVENTION

While the making and using of various embodiments of the present invention are discussed in detail below, it should be appreciated that the present invention provides inventive concepts that can be embodied in a wide variety of specific contexts. The specific embodiments discussed herein are merely illustrative of specific ways to make and use the invention and do not delimit the scope of the invention.

The present invention relates to a door assembly which is adapted to allow reversible modification of the door assembly from a single-swing mode of operation to a double-swing mode of operation when needed, e.g. in a barricade situation.

Figure 1:
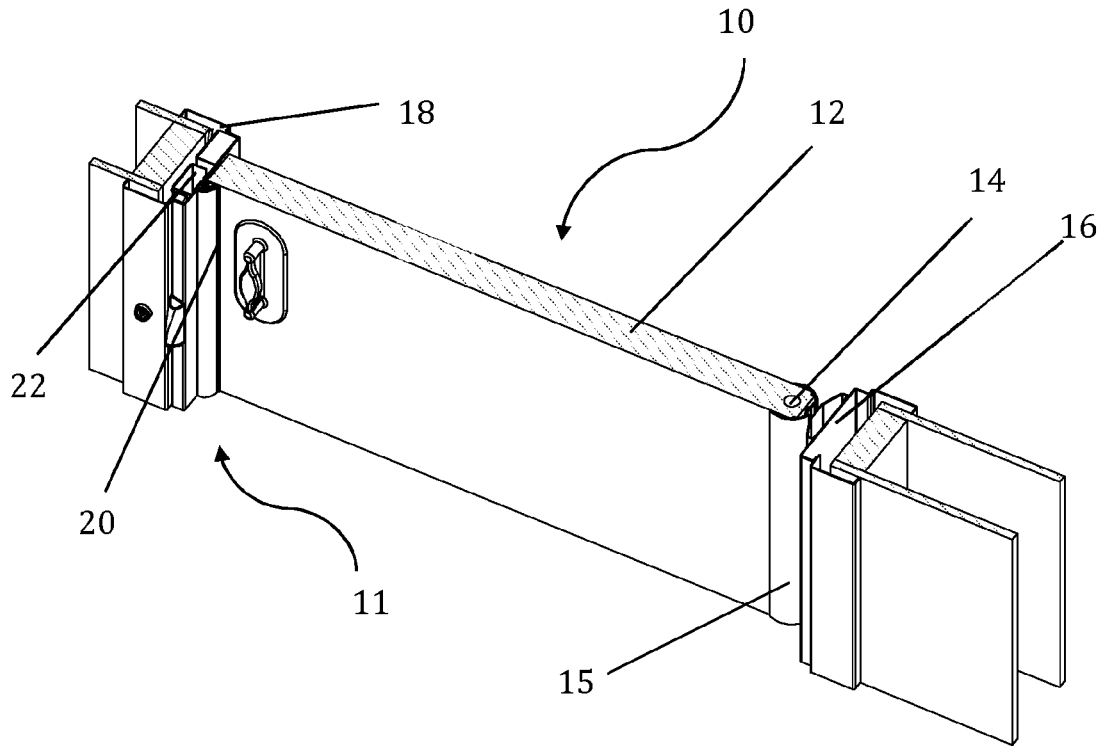
FIG. 1 shows a cross-section of a door assembly according to the present invention with the door stop member in an extended position.

FIG. 1 shows a cross section of door assembly 10 which is an exemplary embodiment of the present invention. The door assembly 10 comprises a door 12, which is pivotably mounted in a frame via a double swing hinge 14. The two vertical door jambs (hinge side jamb 16 and latch side jamb 18) are shown.

As can be seen, the door has a rounded profile 15 at the hinge edge, which cooperated with a profile on the hinge side jamb 16 to provide a hinge which avoids pinch points. The door 12 in this case is primarily wooden, with the exception of the hinge edge profile, which is metal, and the jambs are formed from metal, but they need not necessarily be so.

Figure 2:
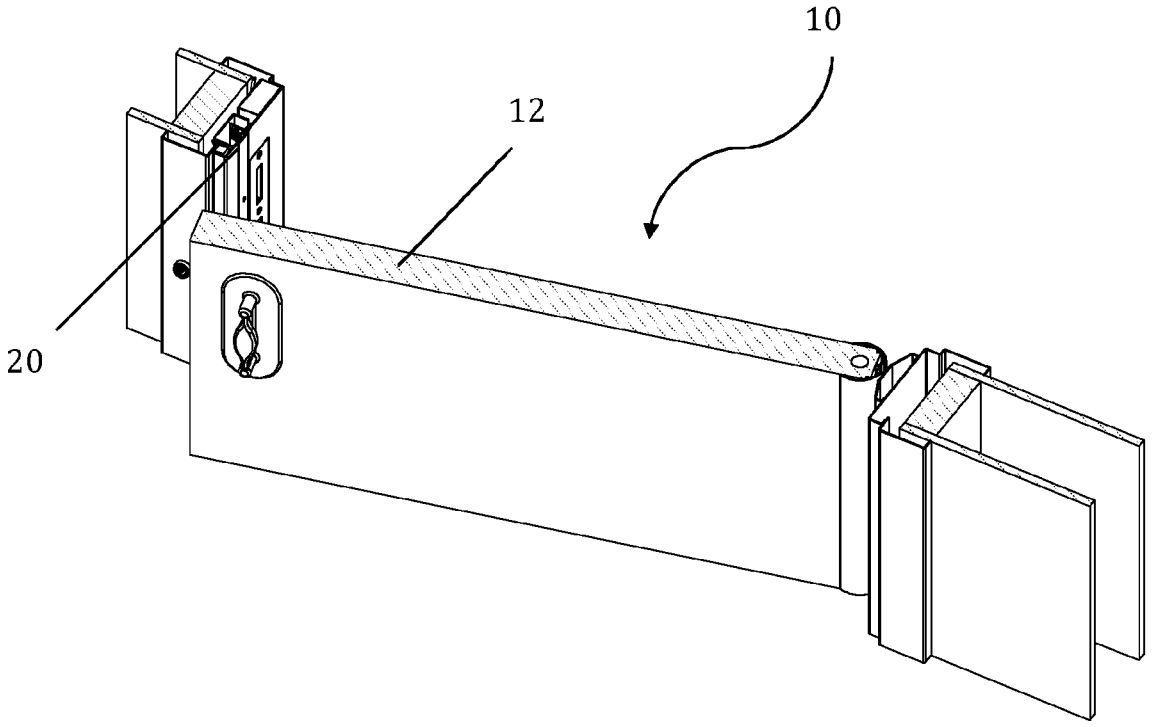
FIG. 2 shows a cross-section of a door assembly according to the present invention with the door stop member in a retracted position.

The latch side jamb 18 is provided with a pivotably mounted elongate door stop 20, which is able to pivot from an extended, door-engaging position, as shown in FIG. 1, to a retracted position, as shown in FIG. 2. The door stop rotates into a corresponding elongate channel 22 provided in the door jamb 18. As can be seen in FIG. 1, when the door stop is in the extended position the door 12 is prevented from passing through the frame by the door stop 20, and the door is thus a single-swing door. As can be seen in FIG. 2, when the door stop is in the retracted position, the door is able to move past the retracted door stop, and thus swing through the frame, and the door is thus a double-swing door. It is a significant advantage of the present invention that the door stop is adapted to move from the extended position to the retracted position as a direct result of force applied to the stop by the door, thus requiring no further intervention from a user.

It will be apparent that retraction of the door stop can be used to allow a user to access the room behind the door when the door has been barricaded; the user simply operates the door assembly to allow the door stop to pivot into the channel, and opens the door outward (i.e. away from the barricade). This allows access to the room behind the door, for example to clear the barricade and access allow patient behind the door.

The door stop 20 and the corresponding channel 22 extend along substantially the entire height of the door 12. This means that when in the extended position, the door stop 20 occludes the gap between the door and the latch side doorjamb, thus providing privacy to the occupant of a room behind the door. It also means that force applied to the stop (e.g. when the door is closed or pushed upon) is spread across the substantial length of the stop, thus minimising point loading compared with, say, a point stop.

Figure 3:
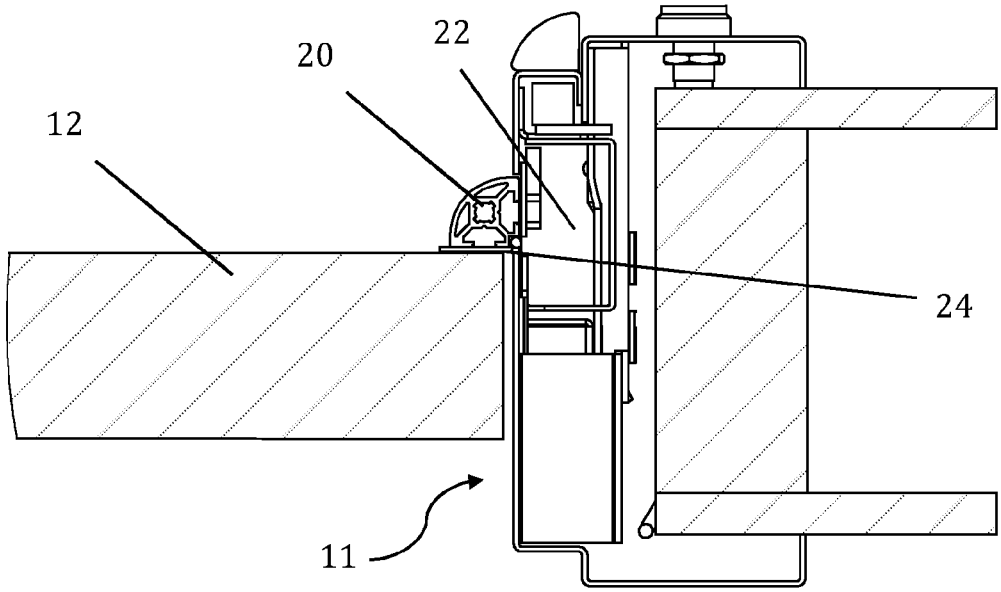
FIG. 3 shows a cross-section of a door assembly according to the present invention, focusing on the door jamb assembly, with the door stop member in an extended position.
Figure 4:
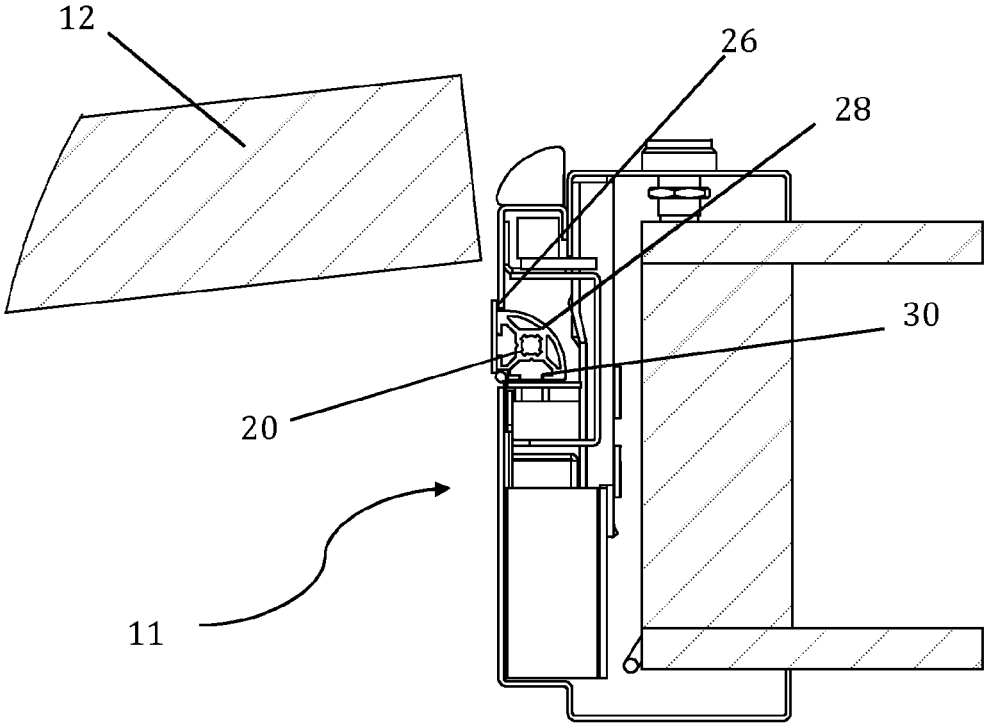
FIG. 4 shows a cross-section of a door assembly according to the present invention, focusing on the door jamb assembly, with the door stop member in a retracted position
Figure 5:
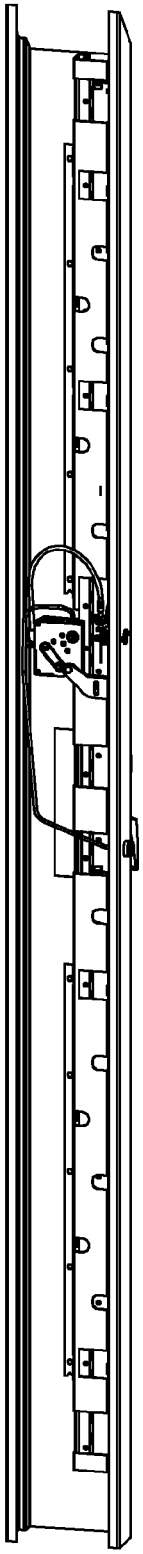
FIG. 5 shows a rear perspective view of a door jamb assembly according to the present invention showing the locking mechanism.

FIGS. 3 and 4 show the door jamb 11 and the door stop 20 in more detail. FIG. 3 shows the door stop 20 in the extended position. FIG. 4 shows the door stop 20 in the retracted position in which it is located substantially within the channel 22.

As can be seen, the door stop 20 comprises an elongate door stop member, which is connected to the door jamb 18 by a continuous hinge 24 (other hinges can be used). The door stop member has a cross section which is generally a quadrant (i.e. a quarter circle sector). The door stop member comprises two planar faces 26,30, one face 26 defining the leading face of the door stop member and a second planar face 30 which defines the back face of the door stop member. Extending between the two planar faces is an arcuate surface 28. The hinge 24 is located at the centre of a circle partially defined by the arcuate surface 28, which in this case is approximately the vertex of the planar faces 26,30. The planar faces 26,30 extend radially beyond the arcuate surface 28 to define elongate projections or lips, which act as stops to limit movement of the door stop member, and also to occlude gaps and provide a neat appearance.

The door stop member can conveniently be formed by extrusion and can be formed of metal or polymeric material.

As can be seen, the channel 22 is shaped and sized to receive the door stop member 20. As the door stop member 20 rotates on the hinge 24, the arcuate surface 28 moves past the edge of the channel 22, and the gap between the arcuate surface and the edge of the channel remains substantially constant as a result of the relative positions of the hinge and the arcuate surface. The lips provided on door stop member act as stops which limit the extent of movement as they contact the edge of the channel when the door stop member is either fully extended or fully retracted. The lips also occlude the gap between the edge of the channel and the arcuate surface which prevent insertion of anything into the gap and provides a pleasing aesthetic.

A locking mechanism is provided to hold the door stop in the extended position during normal operation of the door. In the embodiment shown the locking mechanism is a multi-point locking mechanism, and employs a plurality of cooperating rollers 40 and wedges 42 as latching members. Other locking mechanisms could of course be used, and the specific embodiment describes is in no way restrictive.

Figure 7:
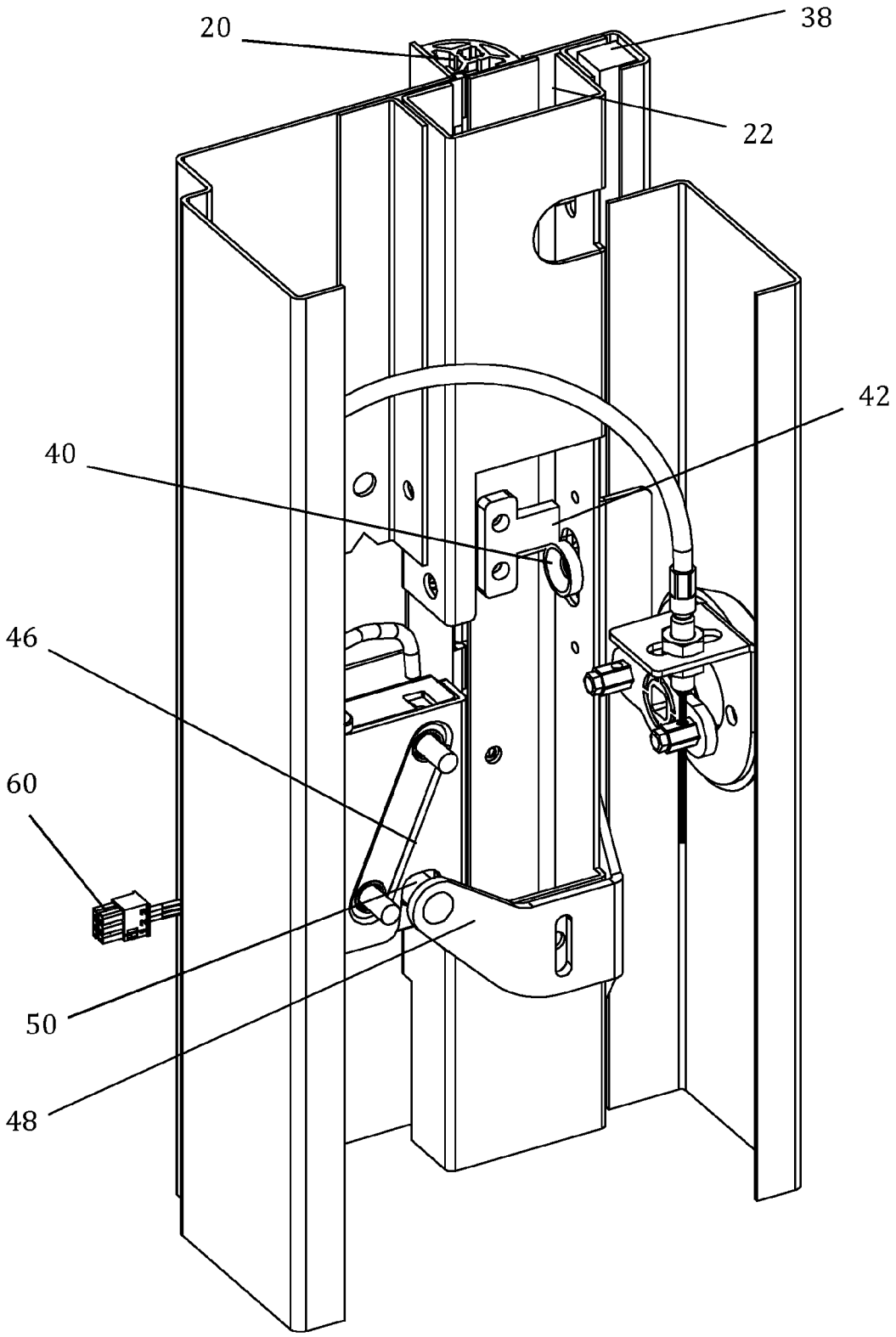
FIG. 7 shows a detailed view of the door jamb assembly of the present invention, focusing on the locking means, with an elongate actuation member in the locked position.
Figure 8:
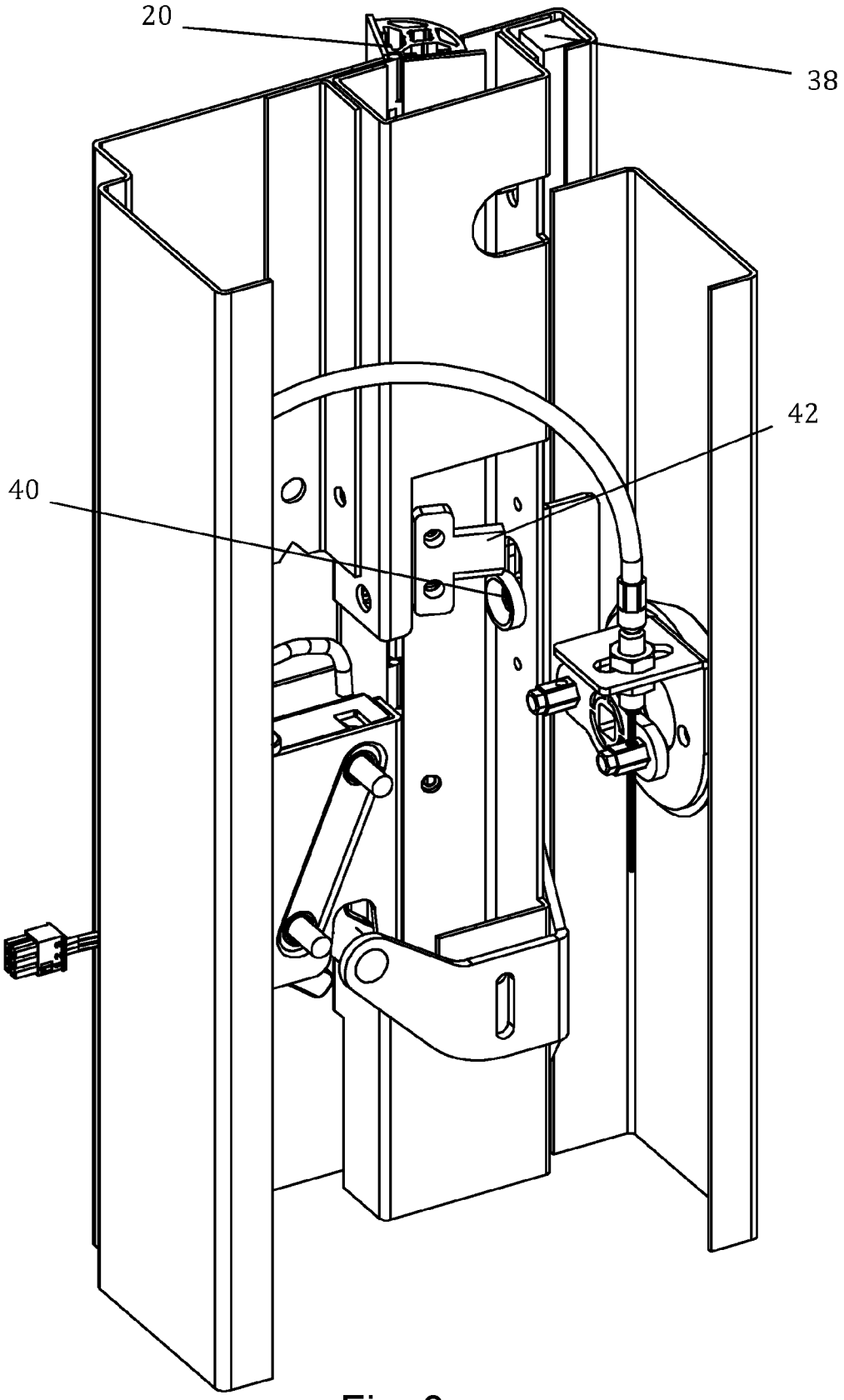
FIG. 8 shows a detailed view of the door jamb assembly of the present invention, focusing on the locking means, with the elongate actuation member in an intermediate position.
Figure 9:
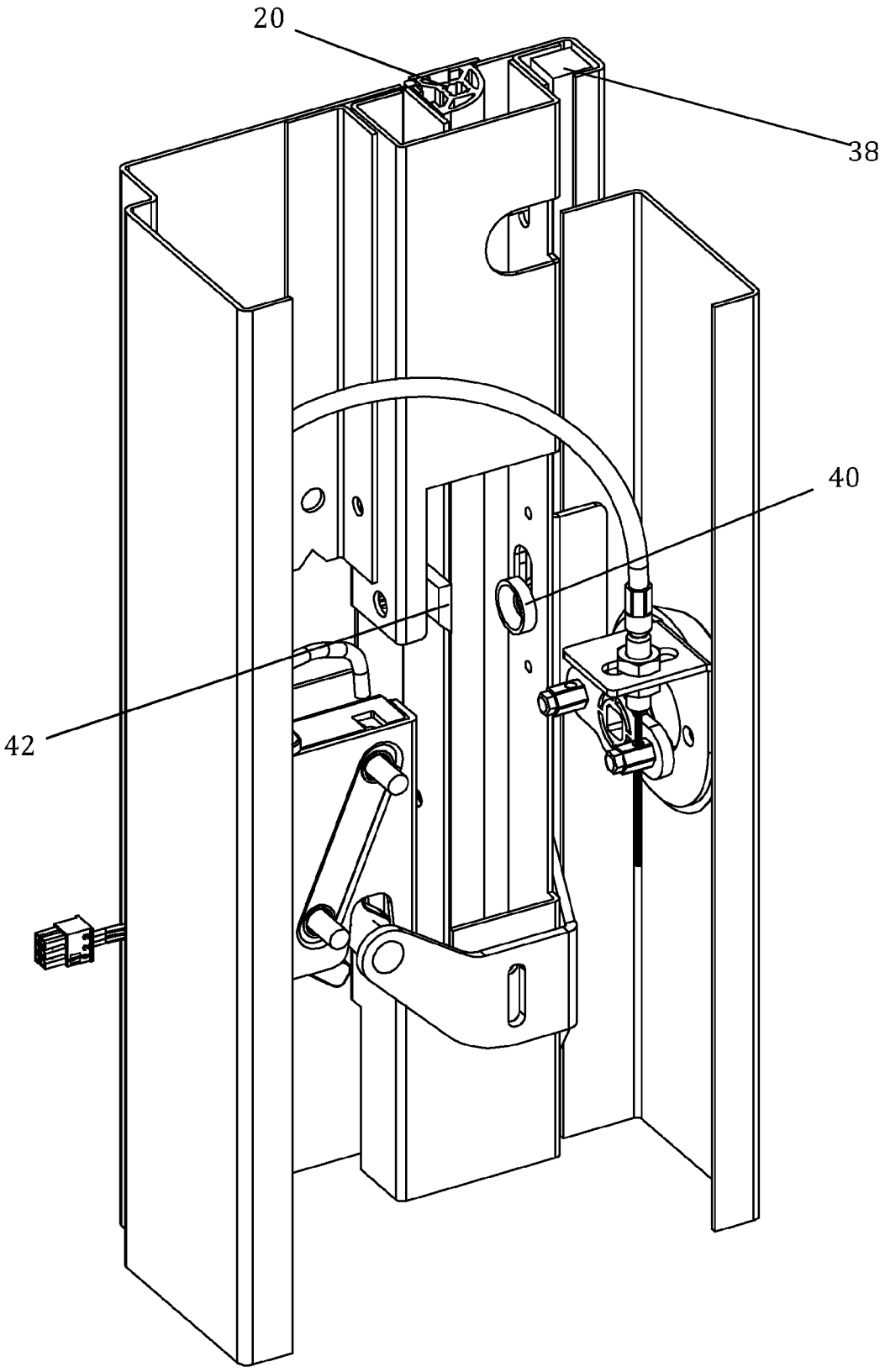
FIG. 9 shows a detailed view of the door jamb assembly of the present invention, focusing on the locking means, with the elongate actuation member in the unlocked position.

In more detail (and as best shown in FIGS. 7 to 9), the locking mechanism comprises an elongate actuation member, in this case an actuator rod 38 which has a substantially square cross-section. A plurality of rollers 40 are provided on the actuator rod 38 at spaced intervals. The rollers 40 are adapted to selectively engage corresponding wedge-shaped 42 projections mounted on the door stop member 20; in the embodiment shown the wedge-shaped projections are fixed to the door stop member 20 with screws. Only one cooperating pair of rollers/wedges is shown in FIGS. 7 to 9. The actuator rod is slidably mounted in a track adjacent to the channel 22, and the rollers 40 extend into the channel 22 though apertures provided in the wall of the channel separating the channel form the track. The actuator rod 38 is able to slide longitudinally in the track, and this consequently moves the rollers mounted thereupon. The actuator rod can be moved from a locked position (see FIG. 7), in which the rollers 40 engage and abut against the wedges 42, and hold them, and consequently the door stop member, in the extended position, to an unlocked position (see FIGS. 8 and 9), in which the rollers 40 are clear of the wedges 42, and the wedges are thus free to move; the door stop 20 can thus move into the retracted position within the channel 22. FIG. 8 shows an intermediate position in which the rollers 40 are disengaged from the wedges 42 and the door stop 20 is half way between the extended and retracted positions. While only a single pair roller/wedge latch members is shown in FIGS. 7 to 9, it will be appreciated that a plurality of cooperating pairs rollers 40 and wedges 42 are provided along the length of the actuator rod and door stop member. Suitably from 5 to 10 cooperating pairs of rollers/wedges can be provided.

An actuator arm 48 is provided which is coupled to the actuator rod 38 such that movement of the actuator arm 48 results in movement of the actuator rod. The actuator arm 48 is provided with a bolt 50 at the end distal to the actuator rod. This bolt 50 is adapted to releasably engage a latch which is controlled by a controller 46. The controller 46 is operable by a user to open the latch and release the bolt. The actuator arm and the actuator rod are then free to drop down (e.g. under the action of gravity or assisted by a resilient means such as a spring) and the rollers are thereby moved from a locked position to an unlocked position, and thereby disengage from the wedges. In the present case the controller is an electronic controller. Exemplary controllers include the R4-EM—Electronic Rotary Latch and the EA-R02—RF Wireless Remote Controller, both from Southco® (http://www.southco.com/en-gb/r4-em?hid=7336&q=r4 and http://www.southco.com/en-gb/ea-r02). The controller can be activated by any suitable means, e.g. using a keypad, fob, key-card or the like. An electrical connector 60 allows the electrical controller to be connected to an electricity supply, and optionally to additional communication lines, e.g. to permit remote release.

Instead of an electronic controller a mechanical controller can of course be used, e.g. one which can be operated with a key or other manual tool. An exemplary mechanical controller is the R4—Rotary Latch from Southco® (http://www.southco.com/en-gb/r4-r?hid=7318&q=r4).

A failsafe mechanism is included which allows the locking mechanism to be released if, for example, the primary (e.g. electrical) system fails. A mechanical failsafe is typically provided, and this can suitably comprise a key operated mechanical override such as the R4-EM Mechanical Override System from Southco® (http://www.southco.com/en-gb/r4-em-mo).

It will be noted that the door stop can move to the retracted position without any input from the user, e.g. pulling or otherwise moving the door stop. It is a significant advantage of the system of the present invention that force from the door moving outwards alone is able to push the stop into the retracted position. This means that a user does not need to place a hand anywhere near the door stop, which is potential dangerous; for example, if this was not the case and manual movement of the door stop was required, the door could swing out hitting the users hand and possibly resulting in a pinch/crush injury, e.g. if the users hand is caught between the door and the jamb or door stop; this is a problem issue with many prior art systems.

The multi-point locking mechanism described above allows for a very secure, but easily releasable locking arrangement. However, the person skilled in the art could select other locking mechanisms, and many such mechanisms are well-known in the art.

Figure 6:
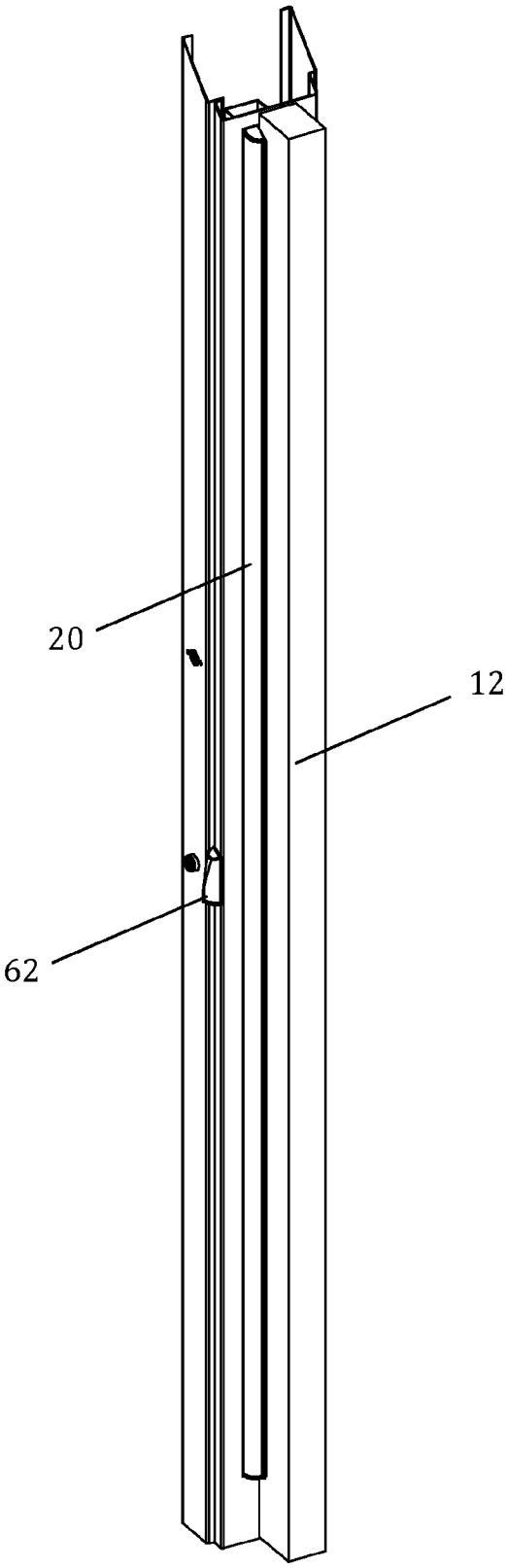
FIG. 6 shows a front perspective view of a door jamb assembly according to the present invention.

Once the door stop has been moved to the retracted position it typically remains in the retracted position until the locking mechanism is reset. In the embodiment shown, the door stop is reset by moving the door into a suitable position, i.e. somewhere in its normal operating arc, the door stop is then manually pulled out into the extended position, and a reset lever 62 (FIG. 6) is manually operated to return the, bolt, actuation arm, actuation rod and rollers to the locked position. Of course, the reset function could be automated, but the mechanical simplicity of this approach is attractive.

In use, when a barricade situation arises, a user activates the controller 46 (e.g. using a fob and corresponding electronic detector) which releases the latch. The bolt 50 is released and the actuator arm 48 and actuator rod 38 move downward. This movement is typically driven primarily by the action of the tapered wedges acting on the rollers, which urges the rollers downward, but may also result from the action of gravity if such force is absent. The downward movement results in the rollers 40 moving out of engagement with the wedges 42. This in turn renders the door stop 20 free to rotate about the hinge 24 from the extended position into the retracted position—further movement of the door stop is limited by lip defined by the planar face 26. Movement of the door stop results from force applied to the door stop by the door—this is typically force imparted by the barricade, but if no force is imparted by the barricade a user can pull on a handle provided on the door. Critically, the user does not need to manually move the door stop, and thus avoids the risk of injury when the door opens.

Once the barricade situation has been resolved, the user swings the door back into its normal arc of operation (i.e. the range of movement when the door is operating in single-swing mode). The door stop is then manually brought back into the extended position (e.g. by gripping the lip, or optionally an additional grip or aperture allowing the user to easily manipulate the door stop—not shown). The door stop is then locked in the extended position by actuating a reset mechanism which moves the actuation rod 38 back into the locked position, and the bolt 50 back into locking engagement with the latch. The door then operates as a conventional single-swing door until another barricade situation arises.

The door assembly as described above has several advantages over known systems, including:

- Door stop is fully retained (permanently attached to door frame.
- It is fast to operate because of the intuitive actuation method and the 'action' of the door stop requires no input from the user after the locking mechanism is released.
- The door stop retraction operates in the same direction as, and is assisted by, the swing of the door—this minimises the chance of the door stop mechanism jamming.
- Hand position of operator can be away from the door edge at all times—this minimises risk of hand trapping events.
- Body position of operator can be to the side of the door—this minimises the risk of the door opening with great force and knocking the operator.
- Discreet, 'normal' (homely) aesthetics because the hinging/operational mechanism is concealed within the frame, unlike competitor products where often the hinging mechanism is visible (e.g. continuous hinge stop—visible hinge, 'institutional' aesthetics).
- Full height (or nearly full height) door stop conceals gap at door edge for improved privacy and less light leakage.
- Multi-point locking mechanism means it is robust and designed to tolerate large impacts.
- Anti-ligature—minimal protruding parts, any protruding parts are bevelled/sloped.
- One point, intuitive actuation (not multipoint actuation like many competitors).
- Versatile range of inputs (can be tailored to suit customer's existing preference)—mechanical and electrical inputs.

Braced Roller in the Locking Means

Figure 10:
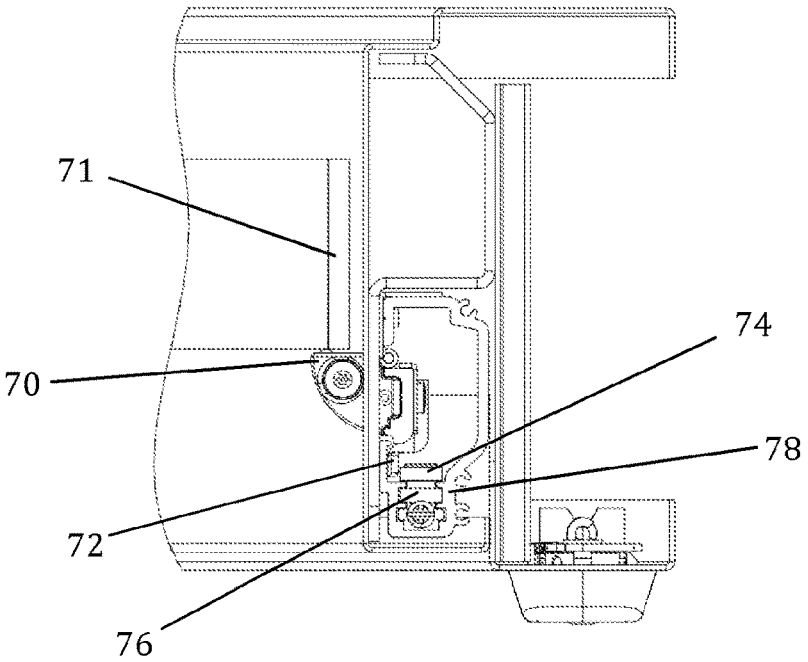
FIG. 10 shows a cross section of a preferred embodiment of the locking means, showing a braced roller.
Figure 11:
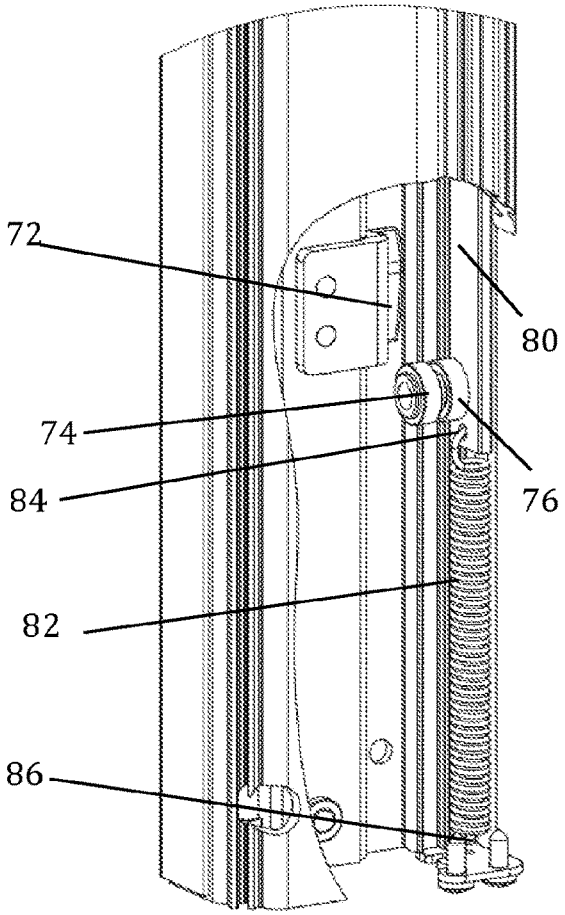
FIG. 11 shows a perspective view of the locking means showing a braced roller and a spring configured to urge the elongate means into the unlocked position.

In the case of a roller and wedge locking means as described above, the inventors have determined that improvements to the locking means can be provided when the roller is braced. FIGS. 10 and 11 show such a braced roller arrangement. As can be seen in the cross section of FIG. 10, a door stop member 70 is associated with a plurality of wedge-shaped projections 72; in the embodiment shown the door stop member is mounted on a carrier, to which the wedge-shaped projections 72 are connected. The wedge-shaped projections 72 are engaged by a plurality of rollers 74 to lock the door stop member in the extended position. When a force is applied to the door 71, the roller is deflected sideways—to the right in the figure. This deflection can cause the roller to become stiff and, in some cases to bind, which can cause inconsistent release of the locking means. To counter this deflection and improve consistent operation of the locking means a secondary roller 76 is provided. This secondary roller is configured to abut a rigid surface 78 so that force applied to the primary roller 74 is passed onto the surface 78. The surface 78 is conveniently provided on an extruded part of the door jamb assembly, but it could be provided in other ways. This secondary roller 76 is coaxial with the (primary) roller 74. It can take the form of a separate roller, i.e. a roller that is free to rotate independently of the primary roller 74, or both rollers can be defined by a single roller with two annular bearing surfaces. In the latter case, one bearing surface engages the wedge shaped projection and the other engages the surface. When a force is applied to the primary roller, FIG. 11 shows a cut away perspective view of the locking means. In the view provided in FIG. 11 the roller has been moved to a disengaged position, allowing the door stop means to move to a retracted position. The surface 78 cannot be seen in this figure as it has been cut away to reveal the rollers 74 and 76.

Biased Locking Means

Where the locking means comprises an actuator rod, such as in the case of a multi-point locking means comprising corresponding rollers and wedges, it has been found that improved performance can be achieved when the actuator rod is biased, e.g. by a resilient member, towards the released position. This is discussed briefly above, and will be described in more detail below. As can be seen in FIG. 11, the actuator rod 80 (which is equivalent in function to the actuator rod 38 in FIGS. 7-9) is provided with an aperture 84 at its lower end. To this aperture is connected a helical tension spring 82, which spring is connected at its other end to an anchor point. The spring 82 is adapted such that is applies tension to the actuator rod 80 in a downwards direction, i.e. in the direction of movement in which the roller 74 must move in order to move from a locked position to an unlocked position. When the actuator rod is in the locked position it is further from the fixed anchor point than when it is in the unlocked position, thus the spring is elongated compared when the actuator rod in the locked position. The spring therefore acts to assist the locking means in moving from a locked configuration to an unlocked configuration. It has been found that providing a biasing means, such as the spring 82, improves consistency of release and general operation of the locking means.

Failsafe Mechanism

Figure 12A:
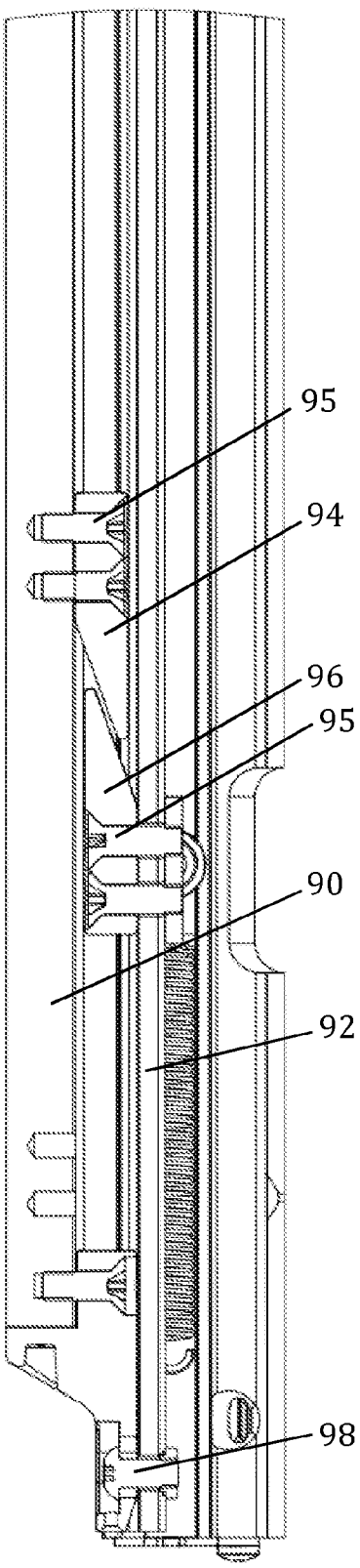
FIGS. 12A-C shows a failsafe mechanism whereby the door stop member can be removed from a carrier, with FIG. 12A showing the door stop member securely connected to the carrier.
Figure 12B:
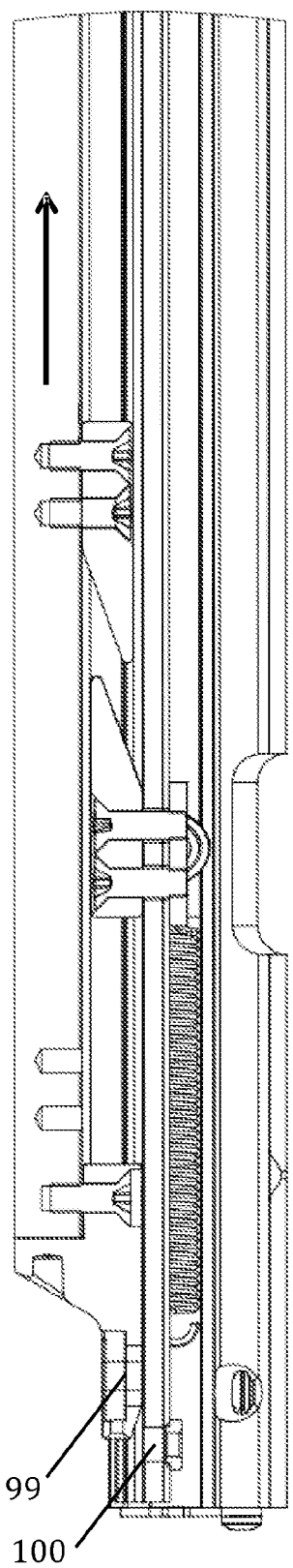
Figure 12C:
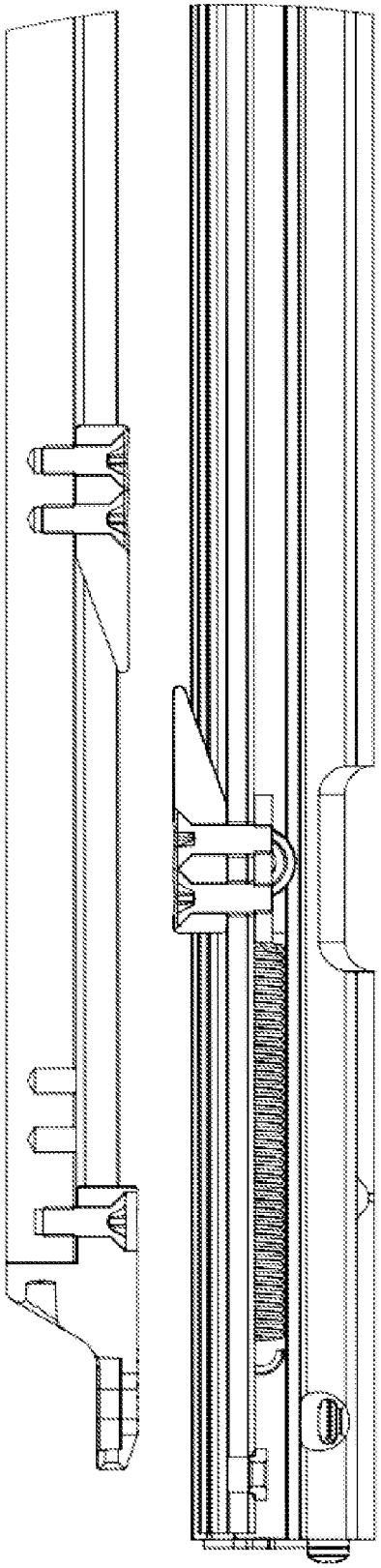

A suitable failsafe mechanism that can be incorporated into the door jamb assembly of the present invention is illustrated in FIG. 12. In embodiments of the door jamb assembly including this failsafe mechanism, the door stop member 90 is connected to a door stop member carrier 92 by a plurality of cooperating, corresponding connectors 94,96 provided on the door stop member 90 and the carrier 92 respectively. In the embodiment illustrated, the connectors are in the form of corresponded wedge members connected to the door stop member 90 and the carrier 92. One pair of corresponding wedges is shown, but there are several others along the length of the door stop member and carrier. The wedge members have a generally trapezoidal cross section when viewed from the side of the carrier/door stop member, having a generally cuboidal body portion and a projection therefrom defining a wedge portion; the wedge portion defines a sloped surface that is adapted to engage with a corresponding sloped surface of a corresponding wedge portion of a wedge member when brought into engagement therewith. The body portion is provided with two apertures, through which connectors (e.g. screws 95) pass to mount the wedge member to the door stop member 90 or the carrier 92. As can be seen in FIGS. 12A and B, when the wedge members are brought into engagement through longitudinal movement of the door stop member 90 relative to the carrier (downwards in the embodiment illustrated) the sloped surfaces of the corresponding wedge members interact to draw the door stop firmly against the carrier 92.

A retaining means 98 is provided that holds the door stop member 90 in position longitudinally, and this has the effect that the corresponding wedge members are held in engagement, with the door stop being securely fastened to the carrier 92. In the embodiment illustrated, the retaining means 98 is a retaining member in the form of a screw, which engages with apertures 99 and 100, provided in the door stop member 90 and the carrier respectively 92. However, many other retaining means can be envisaged, e.g. a catch, pin, or the like.

To remove the door stop member 90 when required, e.g. in an emergency when the primary release mechanism has failed, a user removes the retaining means 98, i.e. in this case by removing the screw. This permits the door stop member 90 to move longitudinally relative to the carrier 92. The door stop member can then be moved longitudinally by the user to disengage the corresponding wedge members; in the embodiment illustrated the user moves the door stop member upwards to achieve this. If necessary, the user can use a suitable tool to assist with longitudinal movement of the door stop member (e.g. a screwdriver or other lever); this may be necessary for example if a force applied on the door stop member by the door prevents free movement of the door stop member as a result of friction. Once the door stop member has been moved longitudinally far enough that the corresponding wedge members no longer overlap, the door stop member can be removed from the carrier 92 and the door can be opened. The carrier 92 does not project beyond the door jamb, such that the door can freely swing past it.

The door stop member can be replaced by aligning it with the carrier, moving the door stop member longitudinally to bring the wedge members into engagement and then securing the assembly by inserting the retention means.

While the present embodiment has been described in terms of corresponding wedge members, it will be apparent that other forms of corresponding connectors could be used, e.g. connectors with corresponding pins and holes, or suchlike. However, the wedge embodiment is considered to have considerable advantages in terms of consistent release when required, even when there is considerable force acting on the door stop member, e.g. because of a barricade.

Door Jamb Assembly Provided at Top of a Door Frame

While typically the door jamb assembly of the present invention is provided in a vertical door jamb, in a further embodiment of the invention the door jamb assembly can be provided at the top of the door, i.e. in a horizontal configuration. The horizontal jamb at the top of a door is sometimes referred to as a header or transom.

This embodiment can be of particular value in the case of double doors, where the non-hinged vertical edge of the door leaf does not meet a vertical jamb and associated door stop, but rather, it meets the other door leaf.

Provision of the door jamb assembly of the present invention at the top of the door means a double door can be converted from a single swing door (when the door stop member is extended) into a double swing door (when the door stop member is retracted). This can be of particular use, for example, in an emergency situation such as a fire alarm where converting a single swing door to a double swing door can aid in ensuring people leaving a building are not impeded.

In particular, the present invention can allow a 'pull only' door to become a 'pull or push' door, with obvious associated benefits for preventing people from becoming trapped or hindered in leaving a building.

The locking means of the door stop member may conveniently be adapted to allow the door stop member to retract as a result of an electrical signal, e.g. a signal occurring when an alarm sounds.

The invention claimed is:

1. A door jamb assembly comprising a door stop member movably mounted thereon, configured such that the door stop member is selectively operable to move from an extended, door-engaging position into a retracted door-disengaging position;

a locking mechanism selectively operable between a locking position, locking the door stop member in the extended door-engaging position, and an unlocking position, allowing the door stop member to move away from the extended door-engaging position; and an actuating mechanism configured to operate the locking mechanism between the locking position and the unlocking position;

wherein the door stop member is configured so that, when the locking mechanism is in the unlocked position, operation of the door will engage the door stop member to initially move away from the face of a door with which it is in contact during use, and into a recess provided in the door jamb assembly.

2. The door jamb assembly of claim 1 wherein the door stop member is pivotably mounted on the door jamb, and thus is selectively operable to pivot from the extended to the retracted position, and is adapted to initially pivot directly away from the door.

3. The door jamb assembly of claim 1 configured such that the stop initially moves in a direction which is substantially perpendicular to, and away from, the face of the door.

4. The door jamb assembly of claim 2 wherein the pivot point of the pivotably mounted door stop member is located substantially in line with the leading face of the door stop member, or wherein the pivot point of the pivotably mounted door stop member is located beyond the leading face of the door stop member, or wherein the pivot point of the pivotably mounted door stop member is located away from the leading face of the door stop member.

5. The door jamb assembly of claim 2, wherein the pivot point of the pivotably mounted door stop member is positioned substantially flush with, or recessed into, the jamb.

6. The door jamb assembly of claim 1, wherein the recess is a channel provided in the door jamb.

7. The door jamb assembly of claim 6 wherein the recess is elongate and is disposed longitudinally in the door jamb.

8. The door jamb assembly of claim 1, wherein the door stop member is elongate and is mounted longitudinally on the door jamb.

9. The door jamb assembly of claim 1, wherein the door stop member and the recess are parallel to each other.

10. The door jamb assembly of claim 6, wherein the recess is of suitable depth and dimensions such that it can receive substantially the entire door stop member when the door stop member is in the retracted position.

11. The door jamb assembly of claim 1, wherein the door stop member is mounted on the door jamb by a hinge means.

12. The door jamb assembly of claim 11 wherein the hinge means is a continuous hinge which runs substantially the entire length of the door stop member.

13. The door jamb assembly of claim 1, wherein the door stop member has a cross-section which comprises a sector of a circle, preferably wherein the door stop member has a quadrant cross-section.

14. The door jamb assembly of claim 1, which comprises at least one stop means which is adapted to limit retraction of the door stop member relative to the door jamb.

15. The door jamb assembly of claim 1, wherein the door stop member comprises at least one projection which is adapted to limit movement of the door stop member and/or to cover a gap between the door stop member and the edge of the recess.

16. The door jamb assembly of claim 15 comprising a second projection which is adapted to limit movement of the door stop member in the direction of the extended position.

17. The door jamb assembly of claim 11, wherein the recess is a channel provided in the door jamb and wherein the door stop member comprises two elongate rectangular planar surfaces, which are angled at between 80 and 120 degrees to one another, the planar surfaces substantially meeting along one long edge of each planar surfaces to form a vertex when viewed in cross-section, the acute or obtuse angle defined by the two planar surfaces comprising a curved surface between the two planar surfaces, wherein the two planar surfaces extend beyond the arcuate surface and thereby define elongate projections which act to limit movement and/or cover a gap between the arcuate surface and the edge of the channel, and wherein the hinge means is provided at or near the apex of the planar members, preferably wherein the pivoting movement of the member is substantially concentric with the actuate surface.

18. The door jamb assembly of claim 8, wherein the door stop member runs substantially along the entire length of the doorjamb.

19. The door jamb assembly of claim 1, wherein the locking mechanism comprises a multi-point locking means.

20. The door jamb assembly of claim 19 wherein the actuating mechanism comprises an elongate actuation member adapted to move a plurality of latch members between the locking position and the unlocking position, the latch members associated with the actuation member cooperating with corresponding latch members associated with the door stop member, whereby in the locking position the latch members associated with the door stop member abut against the latch members associated with the elongate actuation member and thereby prevent movement of the door stop member, and whereby in the unlocking position latch members associated with the door stop member do not abut against the latch members associated with the elongate actuation member and movement of the door stop member into the retracted position is permitted.

21. The door jamb assembly of claim 20 wherein the corresponding latch members associated with the elongate actuation member and the door stop member comprise corresponding rollers and wedges which engage to lock the door stop member in the extended position and disengage to allow the door stop member to retract.

22. The door jamb assembly of claim 21 wherein the rollers comprise bracing means to counteract deflection of the rollers when a force is applied to the leading face of the door stop member, and wherein further the bracing means comprises a secondary roller braced against a surface of the door jamb assembly.

23. The door jamb assembly of claim 19, wherein the multi-point locking means is adapted to be operated from a single point.

24. The door jamb assembly of claim 20, further comprising a control means to control movement of the actuation member, wherein the control means comprises a retaining mechanism which is adapted to releasably retain the actuation member in the locking position.

25. The door jamb assembly of claim 24 wherein the retaining mechanism is adapted such that when the control means is activated by a user, the retaining mechanism is released for passive movement of the actuating mechanism from the locking position to the unlocking position.

26. The door jamb assembly of claim 1, which comprises a biasing means which acts to urge the locking mechanism to the unlocking position to release the door stop member and thereby permit it to move into the retracted door-disengaging position.

27. The door jamb assembly of claim 26 wherein the biasing means comprises a resilient means which acts to urge the locking mechanism from the locking position to the unlocking position.

28. The door jamb assembly of claim 1, comprising a failsafe mechanism adapted to mechanically disengage the door stop member from the locking mechanism.

29. The door jamb assembly of claim 28 wherein the failsafe mechanism allows the door stop member to be removed from the door jamb assembly in the event of failure, and wherein the failsafe system comprises a plurality of corresponding connectors on the door stop member and a door stop member carrier, and disengageable retaining means which holds the corresponding connectors on the door stop member and the carrier in an interlocked relationship, wherein when the retaining means is disengaged the corresponding connectors are able to move to a non-interlocked relationship whereby the door stop member can be removed from the carrier.

30. The door jamb assembly of claim 29 wherein the corresponding connectors on the door stop member and door stop member carrier comprise corresponding wedge elements, the corresponding wedge elements being adapted to engage via corresponding sloped surfaces and securely hold the door stop member on the carrier, and wherein disengagement of the retaining means allows the door stop member to move relative to the carrier and thereby allow the corresponding wedge elements to disengage.

31. The door jamb assembly of claim 29 wherein door stop member is configured to be able to move relative to the carrier when the retaining means is disengaged.

32. The door jamb assembly of claim 29, wherein when the retaining means comprises a removable retaining member that holds the door stop member in a fixed position relative to the carrier.

33. The door jamb assembly of claim 1, comprising a reset mechanism adapted to reset the locking mechanism after it has been released.

34. A door frame comprising a door jamb assembly according to claim 1.

35. A door assembly comprising a door mounted in a frame comprising a door jamb assembly according to claim 1.

36. A method of installing a door frame or a door assembly, the method comprising fitting a door jamb assembly according to claim 1 to the edge of a door aperture in a wall.

37. A method of operating a door assembly comprising a door mounted in a frame comprising a door jamb assembly according to claim 1, the method comprising operating the door stop member to move from an extended, door-engaging position into a retracted position in which it is substantially within a channel provided in the doorjamb.

* * * * *